US010069233B2

(12) United States Patent
Goto

(10) Patent No.: US 10,069,233 B2
(45) Date of Patent: Sep. 4, 2018

(54) FEMALE TERMINAL HAVING AN OUTWARDLY BULGING LANCE LOCKING PORTION ON A FOLDED U-SHAPED PLATE

(71) Applicant: Sumitomo Wiring Systems, Ltd., Yokkaichi, Mie (JP)

(72) Inventor: Yuichi Goto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/696,224

(22) Filed: Sep. 6, 2017

(65) Prior Publication Data

US 2018/0083380 A1 Mar. 22, 2018

(30) Foreign Application Priority Data

Sep. 20, 2016 (JP) ..... 2016-182575

(51) Int. Cl.

| | |
|---|---|
| ***H01R 13/627*** | (2006.01) |
| ***H01R 13/422*** | (2006.01) |
| ***H01R 4/18*** | (2006.01) |
| ***H01R 24/20*** | (2011.01) |

(52) U.S. Cl.

CPC ..... *H01R 13/4223* (2013.01); *H01R 4/185* (2013.01); *H01R 13/6271* (2013.01); *H01R 24/20* (2013.01)

(58) Field of Classification Search

CPC ..... H01R 4/185; H01R 13/052; H01R 13/15; H01R 13/4223; H01R 13/4226; H01R 13/4362; H01R 13/6271; H01R 13/6275; H01R 24/20; H01R 24/76; H01R 13/10; H01R 33/00; H01R 33/76

USPC ..... 439/352, 595, 682, 752, 851, 852

See application file for complete search history.

(56) References Cited

U.S. PATENT DOCUMENTS

| | | | | |
|---|---|---|---|---|
| 8,784,141 | B2 * | 7/2014 | Ishikawa | H01R 43/20 439/595 |
| 9,887,481 | B2 * | 2/2018 | Inaka | H01R 13/426 |
| 2012/0077365 | A1 * | 3/2012 | Kobayashi | H01R 13/4223 439/345 |
| 2013/0072061 | A1 * | 3/2013 | Morikawa | H01R 4/70 439/587 |
| 2013/0288546 | A1 * | 10/2013 | Okano | H01R 13/11 439/852 |

(Continued)

FOREIGN PATENT DOCUMENTS

JP 2002-190342 7/2002

*Primary Examiner* — Chandrika Prasad

(74) *Attorney, Agent, or Firm* — Gerald E. Hespos; Michael J. Porco; Matthew T. Hespos

(57) ABSTRACT

A female terminal (20) has a rectangular tubular box (30) with an outwardly bulging lance locking portion (53). The female terminal (20) is inserted into a cavity (11) of a connector housing (10) and retained by the lance locking portion (53) being locked by a locking lance (13) in the cavity (11). A first wall (37) of the rectangular tubular box (30) has a closely folded structure obtained by folding the metal plate (70) into a U shape. The lance locking portion (53) is formed on the metal plate (70) in an outermost layer of the closely folded structure, and a first deformation restricting portion (55) to be engaged with a second wall (35) adjacent to the first wall (37) is provided on an end part of the metal plate (70) in the outermost layer on a side opposite to a U-shaped folded portion (51).

5 Claims, 8 Drawing Sheets

(56) References Cited

U.S. PATENT DOCUMENTS

| | | | | |
|---|---|---|---|---|
| 2014/0024242 | A1* | 1/2014 | Nagasaka ..... | H01R 13/4223<br>439/350 |
| 2014/0256196 | A1* | 9/2014 | Suzuki ..... | H01R 13/4223<br>439/746 |

* cited by examiner

FEMALE TERMINAL HAVING AN OUTWARDLY BULGING LANCE LOCKING PORTION ON A FOLDED U-SHAPED PLATE

BACKGROUND

1. Field of the Invention

The invention relates to a female terminal and a connector using this female terminal.

2. Description of the Related Art

A connector used at an electrical connection position generally has a terminal accommodated in a cavity of a connector housing and retained by a locking lance formed in the cavity. Japanese Unexamined Patent Publication No. 2002-190342 discloses a female terminal with a rectangular tubular box and a retaining projection that bulges out on a wall of the rectangular tubular box. A cut is formed in the front surface of the retaining projection, and the tip of the locking lance is fit into the cut to retain the terminal fitting in the cavity.

The terminal fitting of this type is manufactured by press-working a metal plate material. The use of a thinner metal plate material may be required for a reduction of material cost, weight saving and the like. However, if a plate thickness is reduced, the rigidity of the retaining projection is reduced. Thus, if a strong pulling force acts on the terminal, the locking lance may deform the retaining projection and it may not be possible to exhibit a sufficient locking force.

SUMMARY

A female terminal disclosed in this specification is formed with a rectangular tubular box, and a lance locking portion bulges out from the rectangular tubular box by bending a metal plate. The female terminal is inserted into a cavity of a connector housing and retained by locking the lance locking portion by a locking lance in the cavity. A first wall of the rectangular tubular box has a closely folded structure obtained by folding the metal plate into a U shape, and the lance locking portion is formed on the metal plate in an outermost layer of the closely folded structure. A first deformation restricting portion is engaged with a second wall adjacent to the first wall and is provided on an end part of the metal plate in the outermost layer on a side opposite to a U-shaped folded portion.

The female terminal thus is inserted into the cavity of the connector housing so that the locking lance in the cavity is engaged with the lance locking portion of the rectangular tubular box. If a force acts on the female terminal in a pull-out direction in that state, the lance locking portion butts against the tip of the locking lance to be retained.

Parts of the metal plate of the closely folded structure obtained by folding the metal plate into a U shape are held in close contact while having twice the thickness in the U-shaped folded portion. Thus, high rigidity is exhibited against a force acting in a direction along the U-shaped folded portion, as compared to a structure obtained by merely bending a metal plate into an L shape. Further, the lance locking portion is formed on the metal plate in the outermost layer of the closely folded structure. Thus, deformation is impeded due to the rigidity of the U-shaped folded portion even if the locking lance exerts a strong force on the lance locking portion. In addition, the first deformation restricting portion is provided on the end part of the metal plate in the outermost layer of the closely folded structure opposite to the U-shaped folded portion and is engaged with the adjacent wall. Thus, a resistance force against deformation is strengthened further.

A second deformation restricting portion may contact the U-shaped folded portion when the lance locking portion receives a reaction force from the locking lance. The second deformation restricting portion may be provided on a wall on a side opposite to the wall engaged with the first deformation restricting portion and adjacent to the first wall. In this configuration, deformation of the metal plate in the outermost layer of the closely folded structure is restricted by plural walls. Thus, a force acting on the lance locking portion can be distributed and received at a plurality of positions so that deformation can be restricted.

A contacting protrusion may be provided on the metal plate in an innermost layer of the closely folded structure and may project inward of the rectangular tubular box for contacting a mating male terminal inserted into the rectangular tubular box. The contacting protrusion and the lance locking portion may be positioned to overlap in an inserting direction of the male terminal. In this configuration, the lance locking portion and the contacting protrusion respectively project outward and inward of the rectangular tubular box. The layer with the lance locking portion and the layer with contacting protrusion are different layers of a double layer structure. Thus, the lance locking portion and the contacting protrusion are positioned to overlap in the inserting direction of the male terminal, and a dimension of the male terminal in the inserting direction can be reduced.

The connector may include the female terminal and the connector housing with the cavity. The female terminal is insertable into the cavity, and the locking lance projects into the cavity.

DETAILED DESCRIPTION

An embodiment is described with reference to FIGS. 1 to 8.

Figure 5:
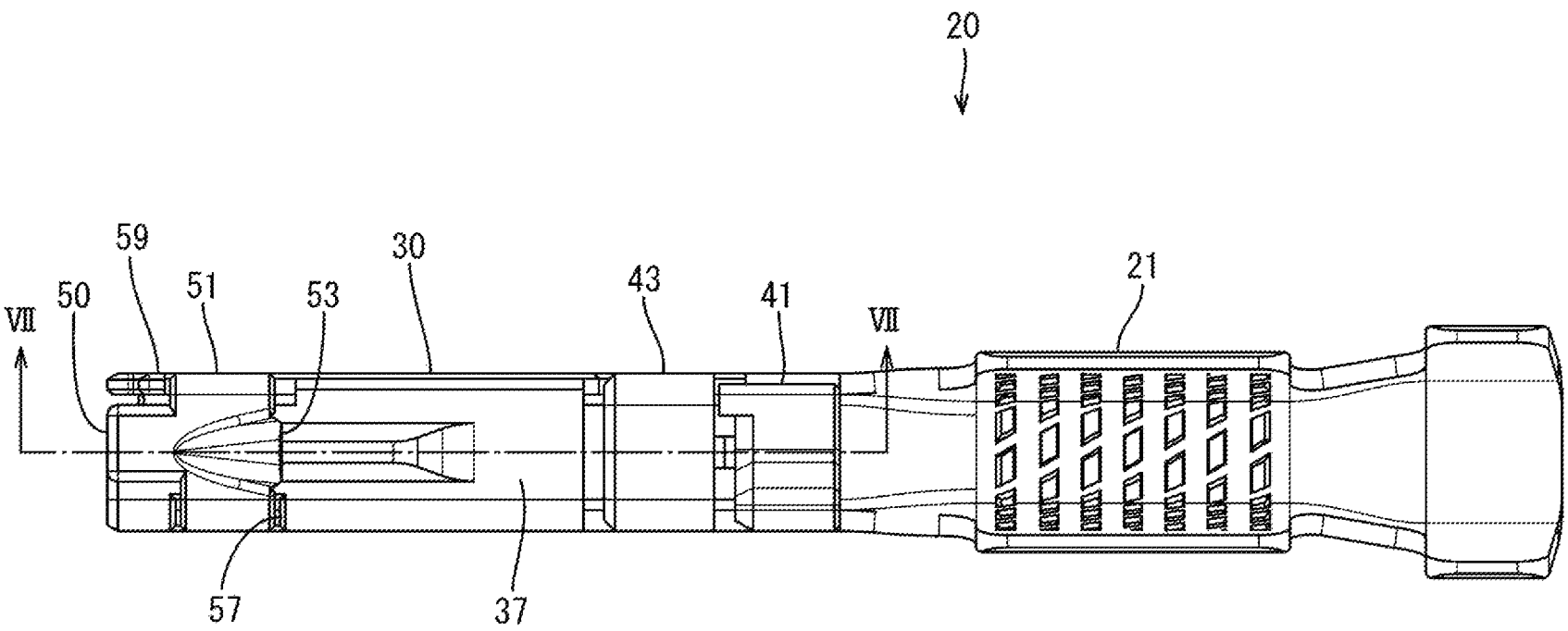
FIG. 5 is a plan view of the female terminal.

A connector C of this embodiment includes a connector housing 10 and a female terminal 20. In the following description, a left side (connecting direction to a mating male terminal) and a right side of FIG. 5 are referred to as a front side and a rear side concerning a front-rear direction. Further, vertical and lateral directions are based on FIG. 3.

Figure 7:
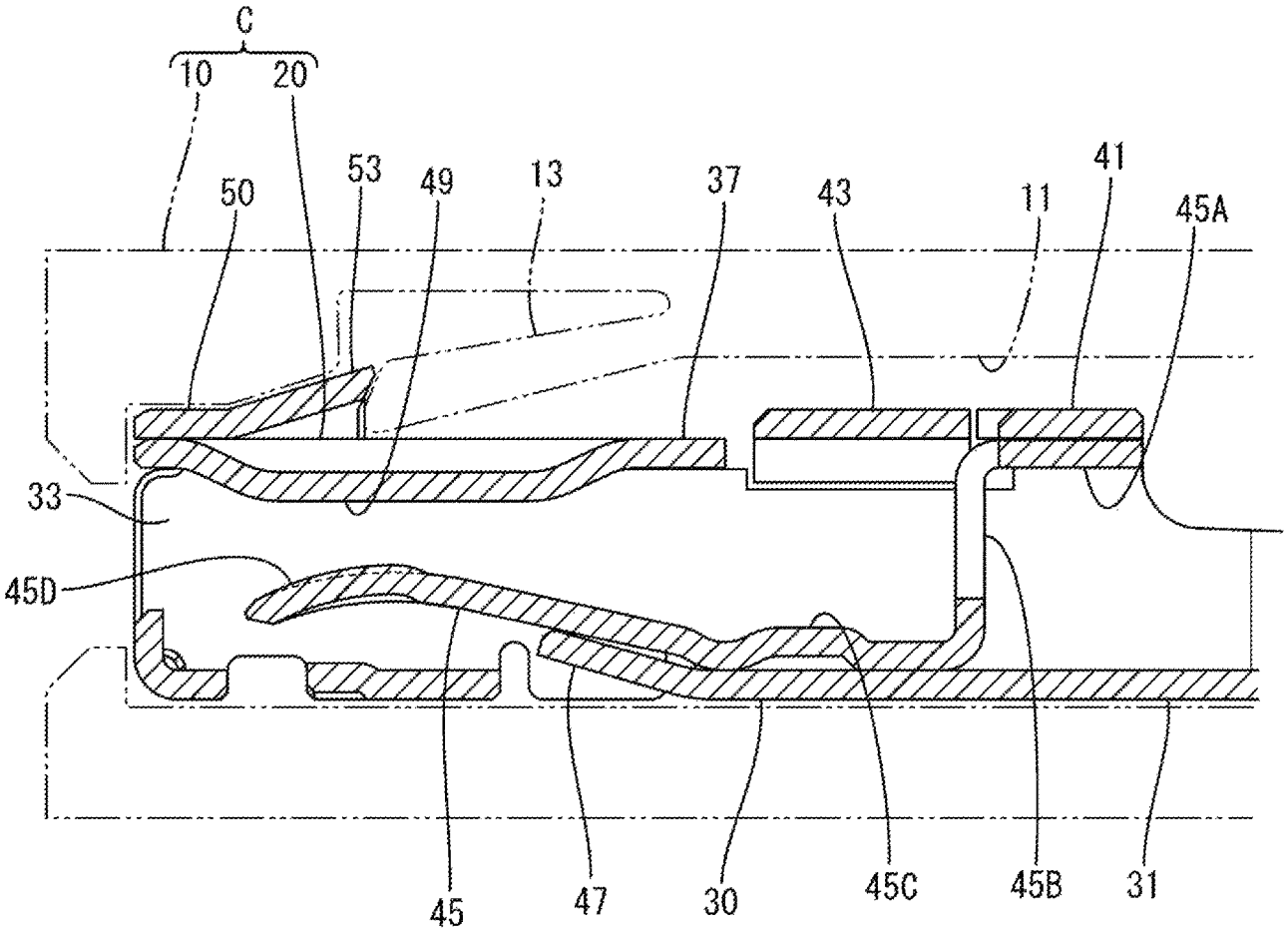
FIG. 7 is a section along VII-VII in FIG. 5.

The connector housing 10 is made of synthetic resin and, as shown in FIG. 7, is provided internally with a cavity 11 extending in the front-rear direction. The female terminal 20 is insertable into the cavity 11. A terminal insertion opening is open in the rear end of this cavity 11, and the female terminal 20 is inserted through this terminal insertion opening. A locking lance 13 is provided on an upper surface in the cavity 11 and is cantilevered forward in the same direction as an inserting direction of the female terminal 20.

The locking lance 13 is deflectable and deformable in the vertical direction and retains and locks the female terminal 20.

Figure 1:
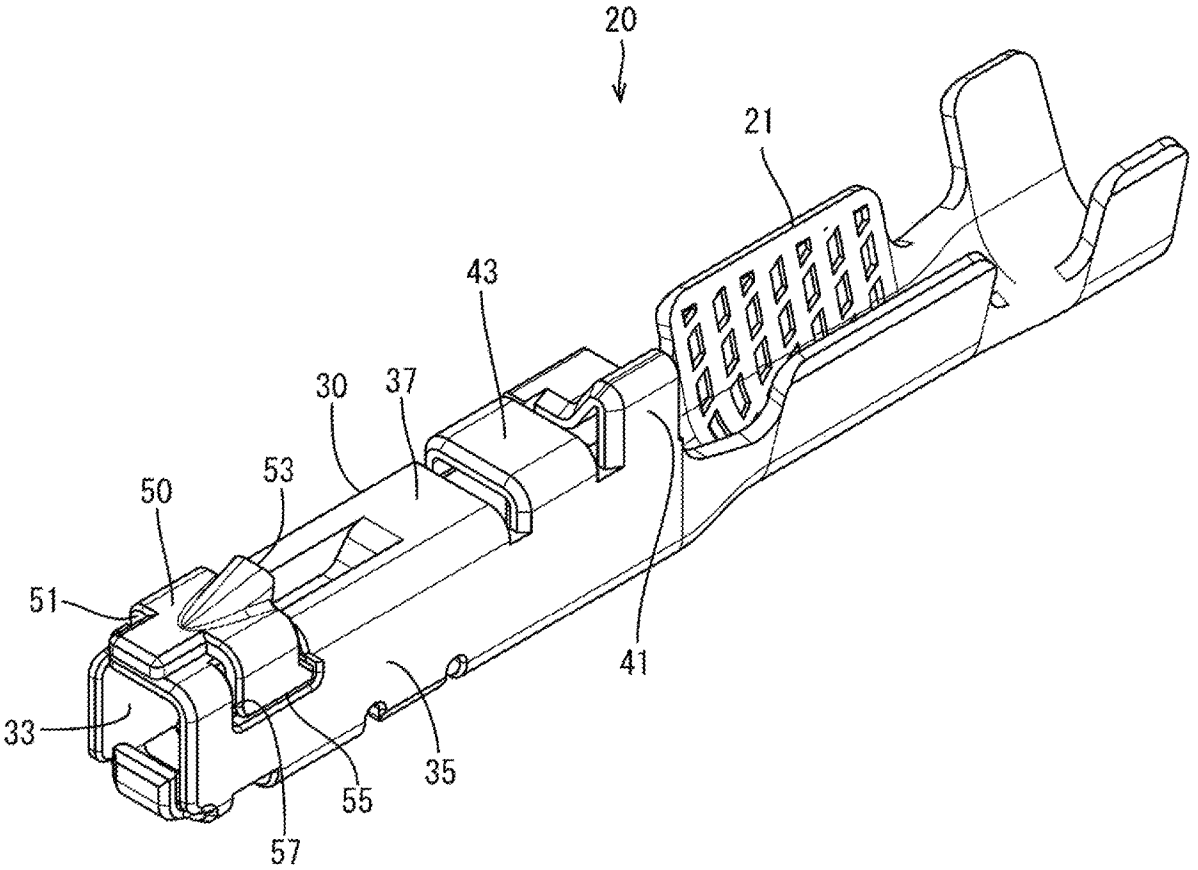
FIG. 1 is a perspective view of a female terminal in an embodiment.
Figure 8:
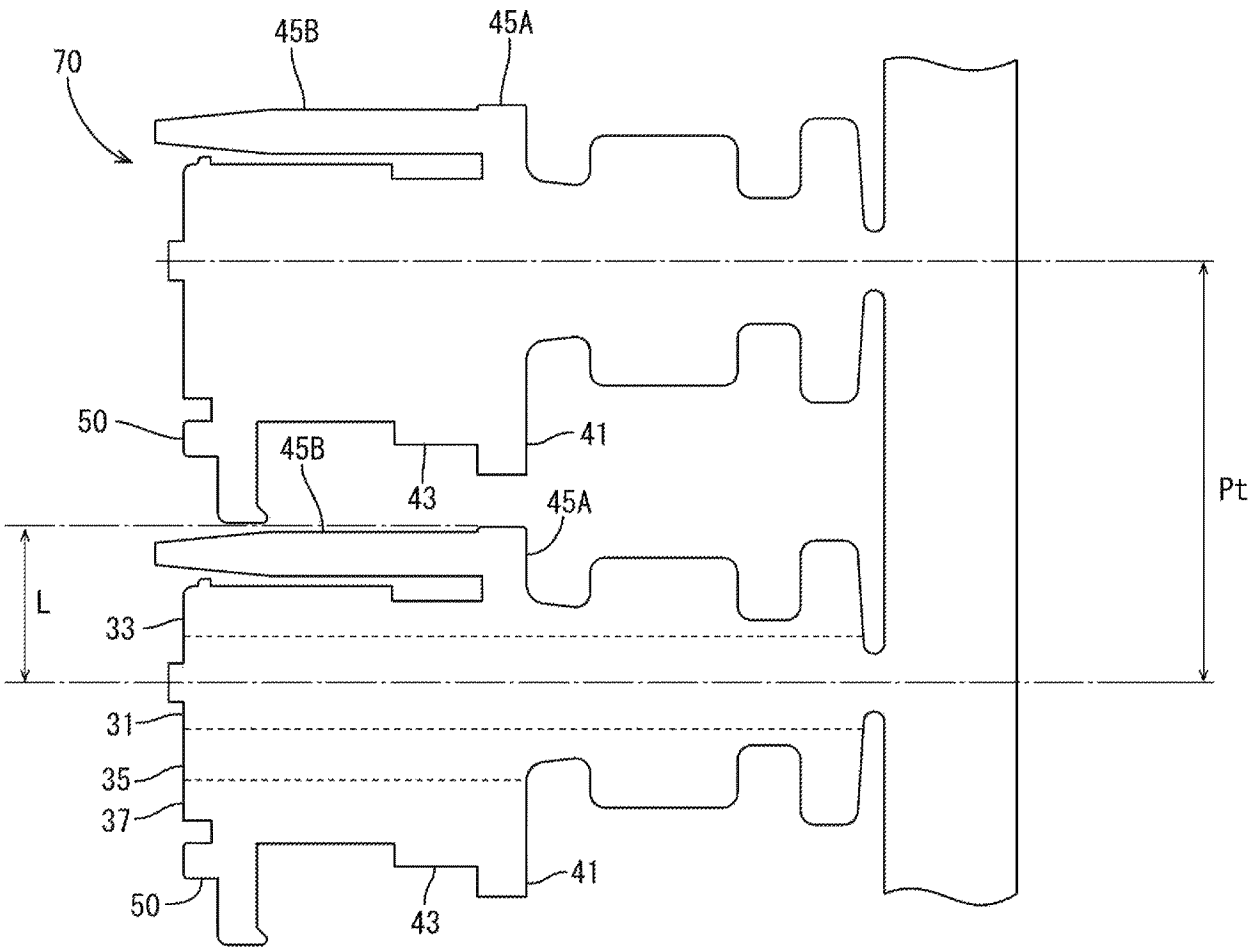
FIG. 8 is a schematic development of the female terminal.

As shown in FIG. 8, the female terminal 20 is formed by stamping a conductive metal plate 70 into a predetermined shape and, then, bending a stamped piece. A thickness of this metal plate is 0.2 mm and smaller than plate thicknesses of general female terminals. As shown in FIG. 1, the female terminal 20 includes a rectangular tubular box 30 and a wire crimping portion 21 extending rearward from the rear end of the box 30. Further, a lance locking portion 53 bulges out on an outer surface side of the box 30 and is to be locked by the locking lance 13.

The box 30 includes a bottom wall 31 extending in the front-rear direction, a left wall 33 rising up at a right angle from the left side of the bottom wall 31, a right wall 35 rising up from the right side of the bottom wall 31 and a ceiling wall 37 (an example of "a first wall") extending leftward from the upper end of the right wall 35. The left and right walls 33, 35 extend in parallel in the front-rear direction and the ceiling wall 37 is facing in parallel with the bottom wall 31. Thus, the bottom wall 31, the left wall 33, the right wall 35 and the ceiling wall 37 define a rectangular tube shape extending in the front-rear direction and open forward and rearward.

As shown in FIGS. 1 and 8, a stabilizer 41 is provided on a rear end part of the ceiling wall 37. The stabilizer 41 has a larger lateral dimension than the ceiling wall 37 in a developed state. The stabilizer 41 rises up while being flush with the right wall 35, and then is folded obliquely down and further is folded to be parallel with the bottom wall 31 at a position higher than the ceiling wall 37 by the plate thickness. Further, as shown in FIGS. 1 and 8, a rising portion 43 is provided in front of the stabilizer 41. The rising portion 43 is bent such that the upper surface thereof is higher than the ceiling wall 37 by the plate thickness.

Further, as shown in FIGS. 7 and 8, a resilient contact piece 45 is provided inside the rectangular tubular box 30. The resilient contact piece 45 is formed by bending a coupling piece 45A extending leftward from a rear end part of the left wall 33 and a bending piece 45B extending forward from the coupling piece 45A in the developed state. The coupling piece 45A is folded to overlap on the inner side (lower side) of the stabilizer 41, the bending piece 45B is bent down into an L shape at the front end of the coupling piece 45A and bent forward into an L shape at a position where the bending piece 45B is in contact with the bottom wall 31 to extend along the bottom wall 31, and a part of the bending piece 45B extending along the upper side of the bottom wall 31 serves as a base end 45C of the resilient contact piece 45. Note that the base end 45C of the resilient contact piece 45 extends forward along the bottom wall 31 up to the same position as the front end position of the rising portion 43.

A spring 45D of the resilient contact piece 45 is cantilevered forward from the base end 45C of the resilient contact piece 45. The spring 45D of the resilient contact piece 45 is resiliently deformable in the vertical direction and contacts the mating male terminal. Further, an auxiliary piece 47 formed by cutting and raising the bottom wall 31 upward is provided below the resilient contact piece 45, and reinforces a resilient force of the resilient contact piece 45.

As shown in FIGS. 1 and 7, the ceiling wall 37 is provided with a contacting protrusion 49. The contacting protrusion 49 is formed by striking the ceiling wall 37 to project into the rectangular tubular box 30 (downward) and extends in the front-rear direction. The contacting protrusion 49 is facing the spring 45D of the resilient contact piece 45 and is connected electrically to the male terminal by sandwiching the male terminal between the contacting protrusion 49 and the resilient contact piece 45.

As shown in FIGS. 1 and 8, an overlapping piece 50 (an example of a "metal plate in an outermost layer") is overlapped on the outer side (upper side) of the ceiling wall portion 37 in a front end part of the ceiling wall portion 37. The overlapping piece 50 is overlapped on the ceiling wall portion 37 by a closely folded structure folded into a U shape at a left edge part of the front end of the ceiling wall portion 37. This part of the overlapping piece 50 folded into a U shape to be held in close contact with the ceiling wall portion 37 serves as a U-shaped folded portion 51. A dimension of the U-shaped folded portion 51 in the front-rear direction is about half the dimension of the overlapping piece 50 in the front-rear direction, and the U-shaped folded portion 51 is located behind the front end position of the ceiling wall portion 37.

The overlapping piece 50 is provided with the lance locking portion 53 bulging outwardly of the rectangular tubular box 30. The lance locking portion 53 is formed by striking a rear end part of the overlapping piece 50 at a center position in a width direction to project outward (up). The lance locking portion 53 is positioned to overlap with the contacting protrusion 49 provided on the ceiling wall 37 serving as an innermost layer of the rectangular tubular box 30 in an inserting direction (front-rear direction) of the male terminal.

Figure 6:
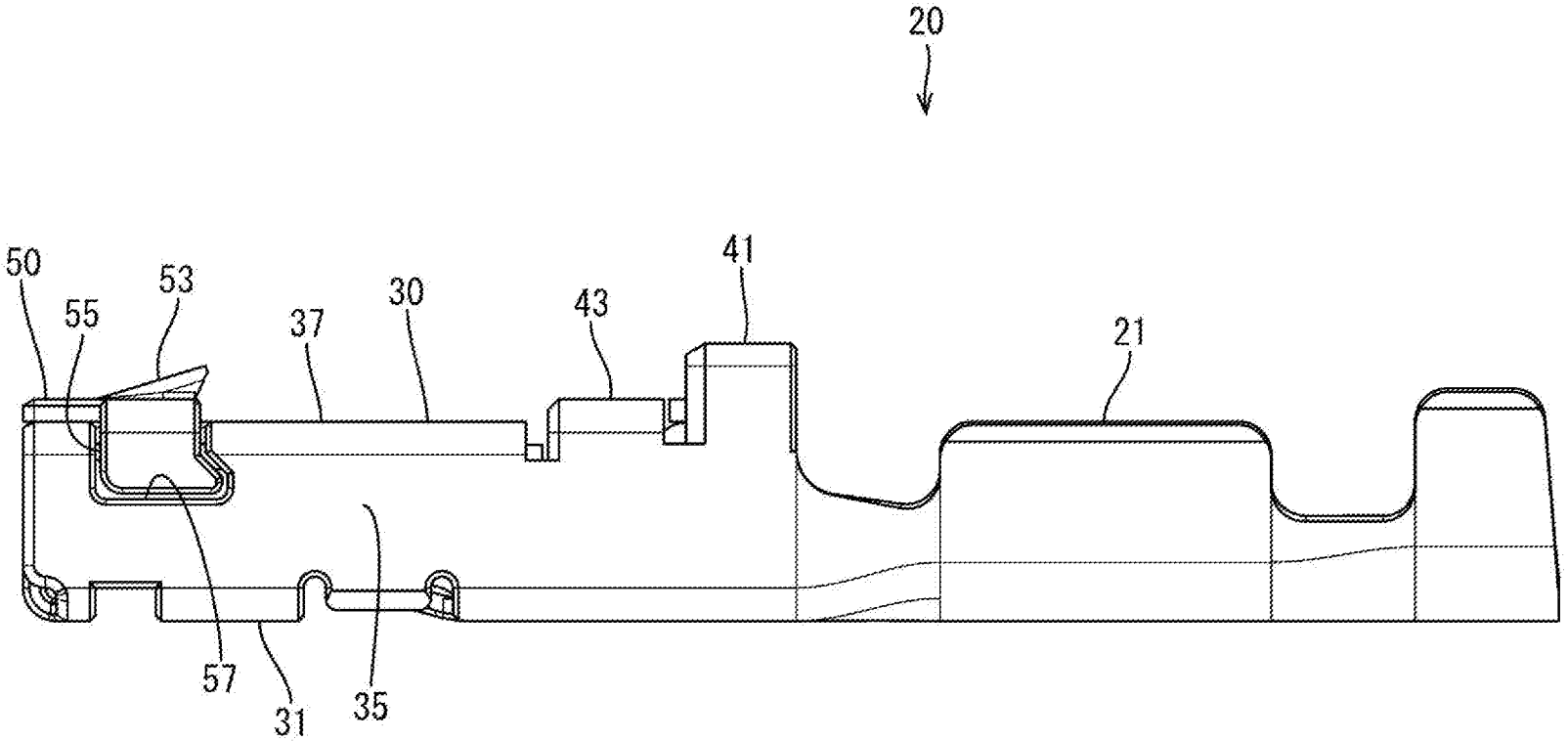
FIG. 6 is a right side view of the female terminal.

Further, as shown in FIGS. 1 and 6, a first deformation restricting portion 55 is provided on an end part of the overlapping piece 50 on a side opposite to the U-shaped folded portion 51. A dimension of the first deformation restricting portion 55 in the front-rear direction is about half the dimension of the overlapping piece 50 in the front-rear direction and the first deformation restricting portion 55 is shifted rearwardly. The first deformation restricting portion 55 is hook-shaped by the rear edge of a tip part thereof projecting rearward. On the other hand, the right wall 35 adjacent to the ceiling wall 37 is provided with an engaging hole 57 to be engaged with the first deformation restricting portion 55. The engaging hole 57 extends down from the upper end of the right wall 35 and is formed into a hook shape at the lower end position thereof. The engaging hole 57 has the same shape as the first deformation restricting portion 55 and inner dimensions thereof are equal to or slightly larger than outer dimensions of the first deformation restricting portion 55. Thus, when being fit into the engaging hole 57, the first deformation restricting portion 55 contacts the edge of the engaging hole 57, thereby restricting movements of the first deformation restricting portion 55 in the front-rear direction and upward direction to restrict the deformation of the overlapping piece 50.

Figure 2:
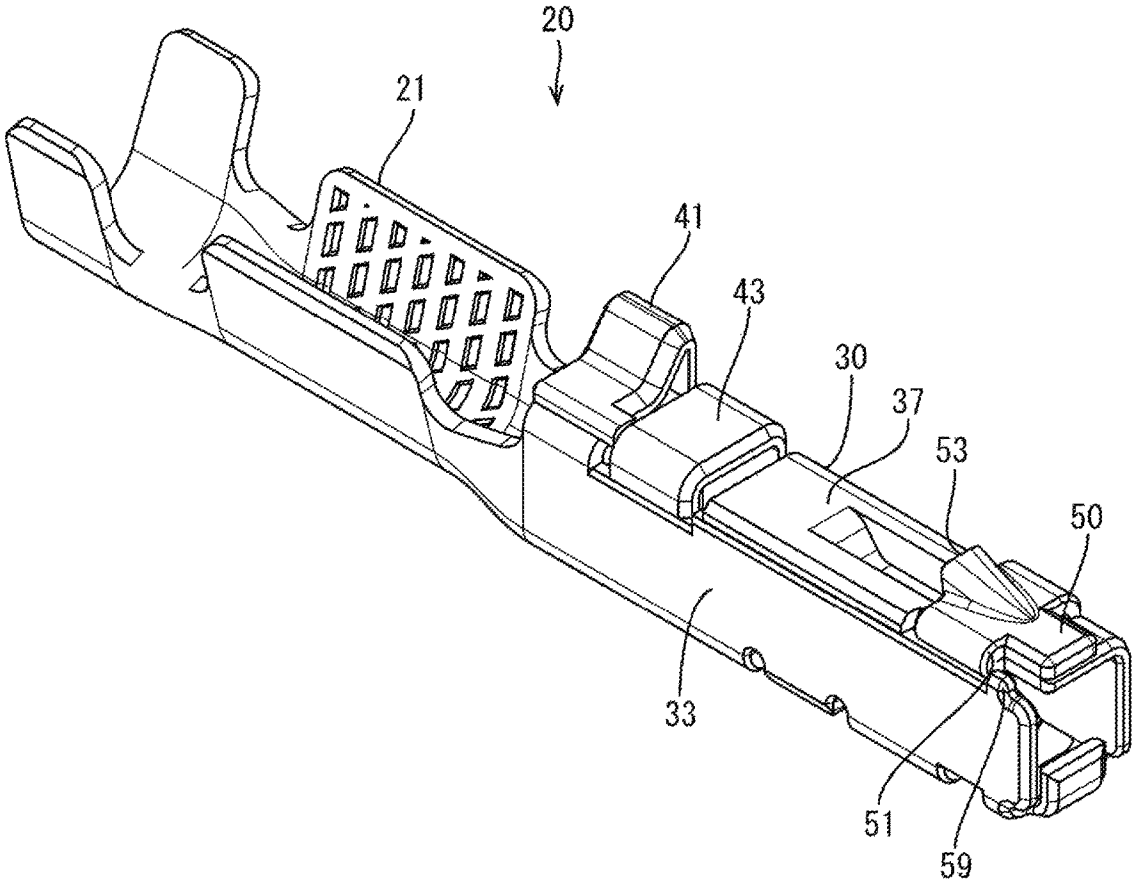
FIG. 2 is a perspective view of the female terminal.
Figure 3:
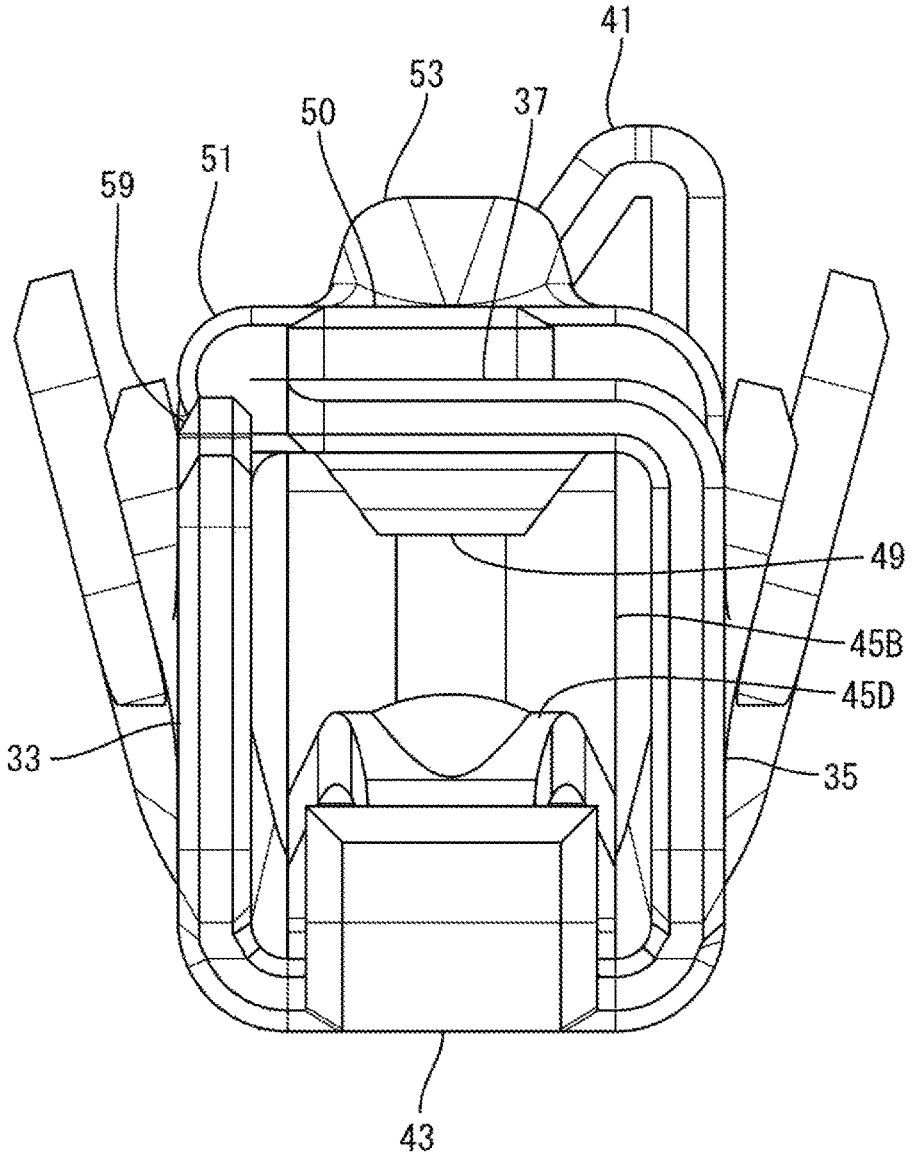
FIG. 3 is a front view of the female terminal.
Figure 4:
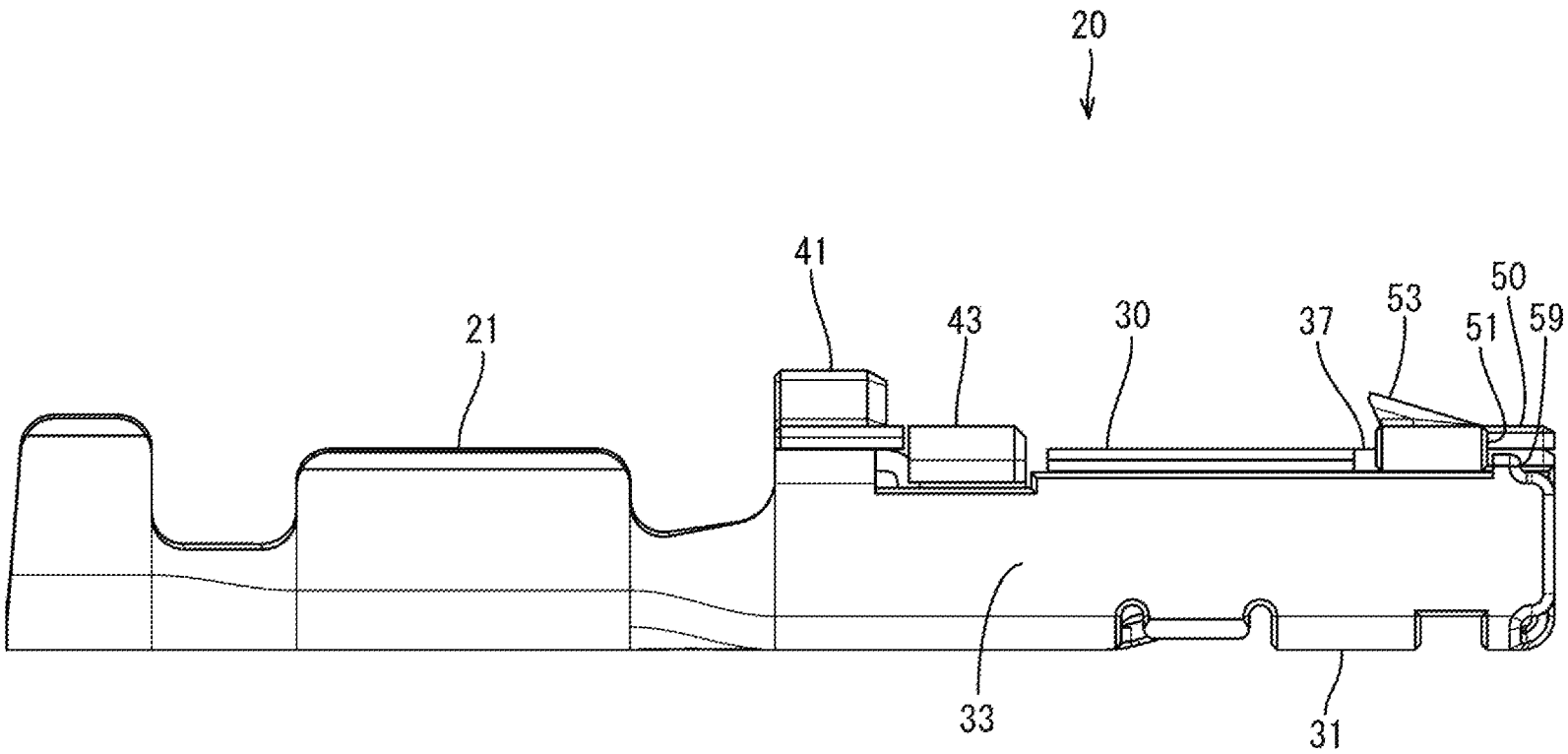
FIG. 4 is a left side view of the female terminal.

Further, as shown in FIGS. 2 and 4, the left wall 33 adjacent to the ceiling wall 37 is provided with a second deformation restricting portion 59. The second deformation restricting portion 59 is formed by an upward projecting front end part of the left wall 33 and located in front of the front end of the U-shaped folded portion 51 and behind the front end position of the ceiling wall 37, and the rear end of the second deformation restricting portion 59 is in contact with the front end of the U-shaped folded portion 51. When the lance locking portion 53 receives a reaction force of the locking lance 13 and a forward force acts, the second deformation restricting portion 59 comes into contact with the U-shaped folded portion 51, thereby restricting a forward movement of the U-shaped folded portion 51 and the deformation of the overlapping piece 50.

Next, functions of this embodiment are described.

First, the female terminal 20 is formed by press-working the conductive metal plate 70. At this time, as shown in FIGS. 7 and 8, the resilient contact piece 45 is bent such that the bending piece 45B is located on the side of the bottom wall 31 from the tip of the coupling piece 45A located on the side of the ceiling wall 37 (inward of the stabilizer 41) so that the base end portion 45C is located on the side of the bottom wall 31. The coupling piece 45A is formed to overlap on the ceiling wall 37 in this way so that a dimension L between end parts of the coupling piece 45A and the bending piece 45B forming the resilient contact piece 45 in the width direction (lateral direction) and a center position of the bottom wall 31 in the developed state is shorter than a dimension when a coupling piece is overlapped on a bottom wall portion. Thus, an interval Pt between the female terminals 20 in the developed state (dimension between center positions of adjacent female terminals 20) becomes smaller, which leads to a cost reduction.

The overlapping piece 50 is folded closely in the U-shaped folded portion 51 to overlap on the outer side of the ceiling wall 37. The ceiling wall 37 and the overlapping piece 50 form a double structure, the ceiling wall 37 is provided with the contacting protrusion 49 projecting inward of the rectangular tubular box 30, and the overlapping piece 50 is provided with the lance locking portion 53 projecting out of the rectangular tubular box 30. Thus, the positions of the contacting protrusion 49 and the lance locking portion 53 can overlap in the front-rear direction and a dimension of the rectangular tubular box 30 in the front-rear direction can be reduced.

When the female terminal 20 is inserted through the rear end opening of the cavity 11 of the connector housing 10 and pushed forward, the locking lance 13 of the connector housing 10 contacts the overlapping piece 50 of the female terminal 20 and is deflected and deformed up. When the female terminal 20 reaches a proper position, the locking lance 13 resiliently returns and a tip part of the locking lance 13 butts against the rear end of the lance locking portion 53 so that the locking lance 13 is locked to the lance locking portion 53. In this state, if a strong force acts on the lance locking portion 53 such as because the female terminal 20 is pulled rearward, the lance locking portion 53 may be deformed.

However, the U-shaped folded portion 51 located on the left end part of the overlapping piece 50 provided with the lance locking portion 53 has a closely folded structure. Thus, parts of the metal plate 70 are held in close contact while having twice the thickness of the metal plate 70. Thus, higher rigidity can be exhibited against a force acting in a direction (front-rear direction) along the U-shaped folded portion 51 as compared to a structure obtained by merely bending a metal plate into an L shape. Therefore, even if a strong force acts on the lance locking portion 53, deformation can be impeded by the rigidity of the U-shaped folded portion 51. Further, even if the U-shaped folded portion 51 itself is going to be shifted by a force upon receiving a reaction force, the U-shaped folded portion 51 comes into contact with the second deformation restricting portion 59 provided on the left wall 33, thereby being able to restrict the deformation of the overlapping piece 50 due to a movement of the U-shaped folded portion 51. On the other hand, the right end part of the overlapping piece 50 serves as the first deformation restricting portion 55 and is engaged with the engaging hole 57 provided in the right wall 35. Thus, the deformation of the overlapping piece 50 provided with the lance locking portion 53 to move up, forward or the like is restricted even if a force acts on the lance locking portion 53. That is, the deformation of the overlapping piece 50 provided with the lance locking portion 53 is restricted by the overlapping piece 50 coming into contact with the adjacent right and left walls 35, 33 at both end parts in the lateral direction (direction perpendicular to a direction of the reaction force of the locking lance 13). Thus, it can be suppressed that the lance locking portion 53 cannot exhibit a locking force such as due to the deformation of the lance locking portion 53.

As described above, the female terminal 20 of this embodiment has a closely folded structure obtained by folding the metal plate 70 into a U shape, and the parts of the metal plate 70 are held in close contact while having twice the thickness of the metal plate 70 in the U-shaped folded portion 51. Thus, high rigidity against a force in the direction extending along the U-shaped folded portion 51 is exhibited as compared to a structure obtained by merely bending a metal plate into an L shape. Further, since the lance locking portion 53 is formed on the overlapping piece 50, which is the metal plate in the outermost layer of the closely folded structure, deformation can be impeded due to the rigidity of the U-shaped folded portion 51 even if a strong force acts on the lance locking portion 53 from the locking lance 13. In addition, since the first deformation restricting portion 55 is provided on the end part (right end part) of the overlapping piece 50 opposite to the U-shaped folded portion 51 and engaged with the engaging hole 57 of the right wall 35, a resistance force against deformation is further strengthened.

The invention is not limited to the above described and illustrated embodiment. For example, the following embodiments also are included in the technical scope.

Although the left wall 33 is provided with the second deformation restricting portion 59 in the above embodiment, it may not be provided. Further, although the second deformation restricting portion 59 is a projection, deformation may be restricted by a wall or the like.

Although the contacting protrusion 49 is provided at the position overlapping with the lance locking portion 53 in the front-rear direction in the above embodiment, the contacting protrusion 49 and the lance locking portion 53 may be provided at positions shifted in the front-rear direction.

Although the plate thickness of the metal plate 70 is 0.2 mm in the above embodiment, this plate thickness is illustrative and may be smaller or larger than 0.2 mm.

LIST OF REFERENCE SIGNS

10 . . . connector housing
11 . . . cavity
13 . . . locking lance
20 . . . female terminal
30 . . . rectangular tubular box
31 . . . bottom wall
33 . . . left wall
35 . . . right wall (second wall)
37 . . . ceiling wall (first wall)
45 . . . resilient contact piece
45A . . . coupling piece
45B . . . bending piece
45C . . . base end
45D . . . spring
49 . . . contacting protrusion
50 . . . overlapping piece (metal plate in outermost layer)
51 . . . U-shaped folded portion

53 . . . lance locking portion
55 . . . first deformation restricting portion
57 . . . engaging hole
59 . . . second deformation restricting portion
70 . . . metal plate
C . . . connector

What is claimed is:

1. A female terminal formed with a rectangular tubular box and a lance locking portion bulging outward of the rectangular tubular box by bending a metal plate, the female terminal being inserted into a cavity of a connector housing and retained by the lance locking portion being locked by a locking lance provided in the cavity, wherein:

a first wall of the rectangular tubular box has a closely folded structure obtained by folding the metal plate into a U shape, the lance locking portion is formed on the metal plate in an outermost layer of the closely folded structure, and a first deformation restricting portion to be engaged with a second wall adjacent to the first wall is provided on an end part of the metal plate in the outermost layer on a side opposite to a U-shaped folded portion.

2. The female terminal of claim 1, wherein a second deformation restricting portion configured to come into contact with the U-shaped folded portion when the lance locking portion receives a reaction force from the locking lance is provided on a wall located on a side opposite to the second wall engaged with the first deformation restricting portion and adjacent to the first wall.

3. The female terminal of claim 2, wherein a contacting protrusion project inward of the rectangular tubular box on the metal plate in an innermost layer of the closely folded structure and is configured to contact a mating male terminal inserted into the rectangular tubular box, and the contacting protrusion and the lance locking portion are positioned to overlap in an inserting direction of the male terminal.

4. The female terminal of claim 1, wherein a contacting protrusion project inward of the rectangular tubular box on the metal plate in an innermost layer of the closely folded structure and is configured to contact a mating male terminal inserted into the rectangular tubular box, and the contacting protrusion and the lance locking portion are positioned to overlap in an inserting direction of the male terminal.

5. A connector, comprising:

the female terminal of claim 1; and the connector housing including the cavity, the female terminal being insertable into the cavity, and the locking lance projecting into the cavity.

* * * * *